US005997399A

United States Patent [19]

Szatmary

[11] Patent Number: 5,997,399

[45] Date of Patent: Dec. 7, 1999

[54] ISOLATION CHAMBER AIR CURTAIN APPARATUS

[75] Inventor: Michael A. Szatmary, Castle Rock, Colo.

[73] Assignee: la Calhene, Inc., Rush City, Minn.

[21] Appl. No.: 09/074,762

[22] Filed: May 8, 1998

Related U.S. Application Data

[60] Provisional application No. 60/046,022, May 9, 1997.

[51] Int. Cl.[6] ..... B08B 15/02

[52] U.S. Cl. ..... 454/187; 454/57

[58] Field of Search ..... 454/187, 58, 57, 454/52

[56] References Cited

U.S. PATENT DOCUMENTS

| | | | |
|---|---|---|---|
| 3,782,265 | 1/1974 | Pielkenrood et al. . | |
| 4,050,368 | 9/1977 | Eakes . | |
| 4,074,620 | 2/1978 | Jansson . | |
| 4,637,301 | 1/1987 | Shields | 454/52 |
| 4,660,464 | 4/1987 | Tanaka . | |
| 4,676,144 | 6/1987 | Smith . | |
| 4,693,173 | 9/1987 | Saiki et al. | 454/52 |
| 4,699,640 | 10/1987 | Suzuki et al. . | |
| 4,838,150 | 6/1989 | Suzuki et al. . | |
| 5,096,477 | 3/1992 | Shinoda et al. . | |
| 5,113,749 | 5/1992 | Perbix . | |
| 5,133,246 | 7/1992 | Campbell | 454/52 |
| 5,145,303 | 9/1992 | Clarke . | |
| 5,195,922 | 3/1993 | Genco . | |
| 5,251,608 | 10/1993 | Cote . | |
| 5,316,518 | 5/1994 | Challenger . | |
| 5,316,560 | 5/1994 | Krone-Schmidt et al. . | |
| 5,487,768 | 1/1996 | Zytka et al. . | |

FOREIGN PATENT DOCUMENTS

| | | |
|---|---|---|
| 833886 | 2/1970 | Canada . |
| 1045885 | 1/1979 | Canada . |
| 61-262537 | 11/1986 | Japan . |
| 64-46528 | 2/1989 | Japan . |
| WO 90/05549 | 5/1990 | WIPO . |

*Primary Examiner*—Harold Joyce
*Assistant Examiner*—Derek S. Boles
*Attorney, Agent, or Firm*—Barnes & Thornburg

[57] ABSTRACT

An apparatus for providing a clean working environment includes an isolation booth, a worker booth, and an access device arranged to enable a worker in the worker booth to handle material in an isolation chamber formed in the isolation booth. A pressure generator is positioned to communicate with the isolation chamber to generate an air pressure therein that is less than the air pressure of an air curtain passing through the worker booth so that air is drawn from the air curtain in the worker booth into the isolation chamber through any air leak opening that develops in and around the access device so as to block outflow of air in the isolation chamber to the worker booth through the air leak opening.

41 Claims, 4 Drawing Sheets

ISOLATION CHAMBER AIR CURTAIN APPARATUS

This application claims benefit of provisional application Ser. No. 60/046,022 filed May 9, 1997.

BACKGROUND AND SUMMARY OF THE INVENTION

The present invention relates to an isolation chamber, and particularly to an isolation chamber in which sterile and/or toxic materials are handled. More particularly, the present invention relates to an isolation chamber air curtain apparatus that functions to maintain a sterile environment in the isolation chamber when a leak develops in the isolation chamber.

During the manufacture of pharmaceutical products or other products, sterile and/or toxic materials are often placed in a decontaminated isolation chamber so that such materials can be handled by a worker properly. An unwanted leak in a material-handling system might lead to contamination of the isolation chamber and/or escape of material in the isolation chamber to the surroundings.

According to the present invention, an apparatus is provided for providing a clean working environment. The apparatus includes an isolation chamber sized to establish a working environment and bounded by a wall formed to include an access port communicating with the isolation chamber. The apparatus also includes an access device, such as a glove, mounted in the access port to enable a worker standing alongside an exterior surface of the wall to handle material in the isolation chamber through the access port without communicating air into the isolation chamber. A pressure generator, such as a motorized blower fan, is positioned to generate a pressure in the isolation chamber that is lower than the pressure of air along the exterior surface of the wall formed to include the access port. Air will be drawn from the surroundings into the isolation chamber through any air leak openings that develop in and around the access device so as to block outflow of air and materials in the isolation chamber through the air leak opening.

In preferred embodiments, an air curtain generator is arranged to discharge a filtered curtain of air pressurized to a level higher than the pressure of air in the isolation chamber so that the filtered curtain of air sweeps along and across the exterior surface of the wall formed to include the access port. If any air leak opening develops in the wall, access port, access device, etc., air from this pressurized curtain of air will flow into the isolation chamber through the air leak opening(s). A system is also provided for changing the "angle of attack" of the air flowing in the curtain of air relative to the exterior surface of the wall and for increasing the mass flow rate of air flowing in the curtain of air upon exposure of an air pressure sensor in the isolation chamber to an air pressure that is above a predetermined pressure level for a certain period of time.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
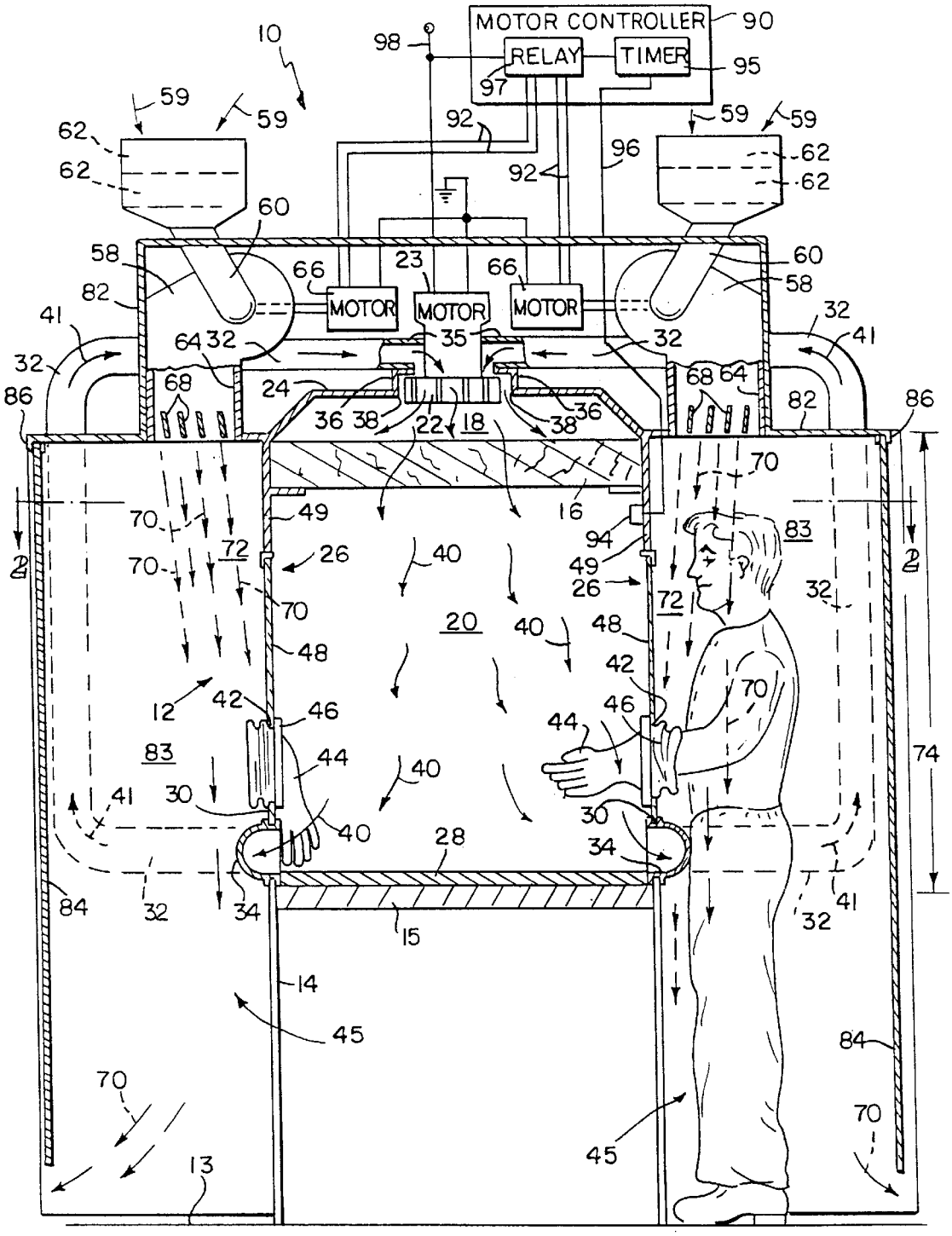
FIG. 1 is side elevation view of an isolation chamber air curtain apparatus according to the present invention showing a person standing in a worker booth beside a side wall of an isolation booth and using a rubber glove to access a sterile and/or toxic material in an isolation chamber inside the isolation booth, a pair of blower fans above each side wall of the isolation booth creating a curtain of clean air adjacent to and along the length and width of each side wall of the isolation booth as indicated by a series of dotted arrows, a flexible drape hanging downwardly from outside edges of a hood that overlies the isolation booth, and showing a diagrammatic view of a control system that monitors air pressure of the isolation chamber and controls the speed of a pair of motors coupled to the blower fans.

An apparatus 10 for providing a clean working environment includes a normally air-tight isolation booth 12 supported above a floor 13 on a pedestal 14 having a support platform 15 as shown in FIG. 1. Isolation booth 12 includes a top cover 24, a bottom cover 28, and one or more side walls 26 extending between top cover 24 and bottom cover 28 and cooperating to define an interior region including an isolation chamber 20. Top cover 24 is formed to include an opening 38 for communicating air into the interior region of the isolation booth.

An air permeable filter 16 partitions the interior region defined between top cover 24, bottom cover 28, and side walls 26 of isolation booth 12 into an air supply plenum 18 which is the space above filter 16 that receives air admitted through opening 38 formed in top cover 24, and an isolation chamber 20, which is the space beneath filter 16 that receives air passed through filter 16. Thus, filter 16 defines the ceiling of isolation chamber 20 and the floor of air supply plenum 18. As shown in FIG. 1, air permeable filter 16 is positioned to lie between air supply plenum 18 and isolation chamber 20 to filter air passing from air supply plenum 18 to isolation chamber 20.

A pressure generator is positioned to communicate with isolation chamber 20 to generate an air pressure in isolation chamber 20 that is less than the air pressure in an air zone 72 outside isolation chamber 20 and alongside one or more side walls 26. This pressure differential causes air to be drawn from air zone 72 into isolation chamber 20 through any air leak openings that develop in and along side wall(s) 26 so as to block outflow of air in isolation chamber 20 to air zone 72 through the air leak opening(s).

In a preferred embodiment, the pressure generator lies in opening 38 formed in the top cover 24 and includes a blower fan 22 that is mounted to blow air in air supply plenum 18 of isolation booth 12 and a motor 23 that is operated to turn fan 22, thereby blowing the air 39 present in air supply plenum 18 downwardly through filter 16 and into isolation chamber 20 to discharge filtered air 40 into isolation chamber 20 and establish a relatively low air pressure in isolation chamber 20. Filter 16 filters and purifies the air 39 being blown therethrough to prevent airborne particles (not shown) from passing along with the air 39 from air supply plenum 18 into isolation chamber 20. Filter 16 can be, for example, a HEPA filter that sufficiently filters the air passing therethrough to a class 100 level or filter 16 can be a higher class of filter, such as a ULPA filter.

Side walls 26 of isolation booth 12 are formed to include one or more vent apertures or air discharge ports 30 adjacent to bottom cover 28. Apparatus 10 includes an appropriate number of return air ducts 32, each having a first end 34 coupled to side walls 26 of isolation booth 12 in an air-tight manner around respective vent apertures 30 so that each return air duct 32 is in fluid communication with filtered air 40 extant in isolation chamber 20. A second end 35 of each return air duct 32 is coupled to a respective plenum inlet duct 36 which is in fluid communication with air supply plenum 18 through openings 38 formed in top cover 24. Plenum inlet ducts 36 are coupled to top cover 24 in an air tight manner.

A series of air flow lines 40 generally illustrate the flow of filtered air within isolation booth 12 as blower fan 22 blows air 39 from air supply plenum 18, through filter 16, and into isolation chamber 20. The continuous flow of air 39 into isolation chamber 20 through filter 16 continuously forces an equivalent volume of filtered air 40 through vent apertures 30 and into return air ducts 32, which continually forces an equivalent volume of return air 41 into plenum inlet ducts 36 through openings 38 and into air supply plenum 18. Thus, air supply plenum 18, filter 16, isolation chamber 20, return air ducts 32, and plenum inlet ducts 36 cooperate to form a continuous air flow path in apparatus 10. Fan 22 operates continually to circulate air throughout this continuous air flow path 18, 16, 20, 32, and 36.

A negative pressure relative to the ambient air pressure of a room in which apparatus 10 is located is maintained in the isolation chamber 20 portion of isolation booth 12 due to the operation of fan 22 or any suitable means. Suction created at plenum inlet ducts 36 by operation of fan 22 results in the pressure in isolation chamber 20 being one-half inch to one inch of water less than the ambient pressure in the room in which apparatus 10 is located.

A sterile environment is created in isolation chamber 20 due to the filtration and purification by filter 16 of the air passing therethrough. Thus, materials requiring a sterile environment can be placed and handled in isolation chamber 20 without becoming contaminated. In addition, materials that emit toxic fumes can be placed inside isolation chamber 20 and the toxic fumes will be circulated and filtered along with the air contained in isolation booth 12 and ducts 32, 36, rather than escaping into the ambient surroundings outside of isolation booth 12 and ducts 32, 36.

Figure 2:
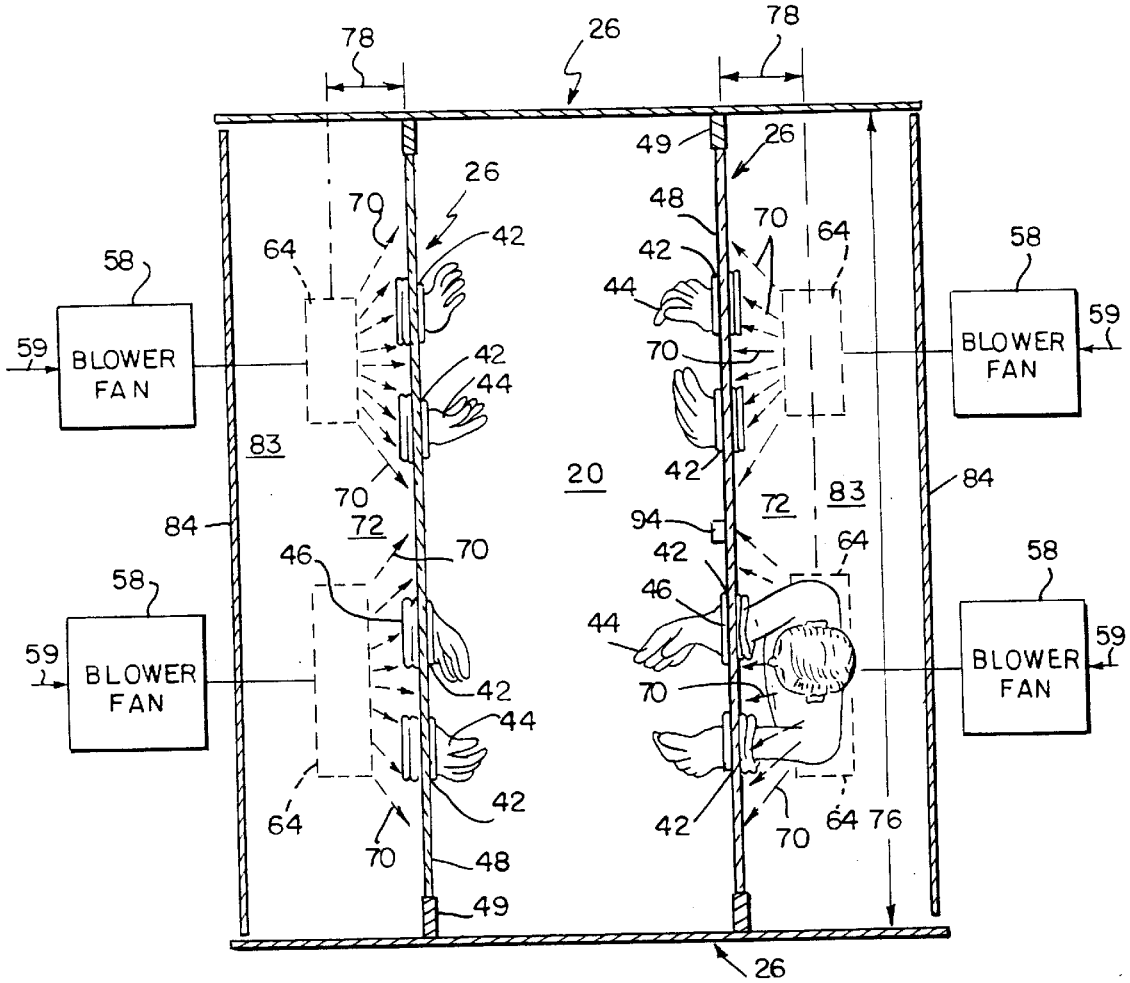
FIG. 2 is a top plan view of the isolation booth, taken along line 2—2 of FIG. 1, showing two pairs of rubber gloves coupled to respective side walls of the isolation booth in an air-tight manner and showing a person standing beside one of the side walls and using one pair of rubber gloves to access the sterile and/or toxic environment of the isolation chamber and showing diagrammatically the use of a first pair of laterally spaced-apart blower fans for creating a curtain of clean air on one side of the isolation booth in an occupied worker booth and a second pair of laterally spaced-apart blower fans for creating another curtain of clean air on another side of the isolation booth in an unoccupied worker booth.

Side walls 26 of isolation booth 12 include a plurality of access ports or arm holes 42. Access devices such as rubber gloves 44 having glove rings 46 that attach to side walls 26 in an air-tight manner around arm holes 42, extend into isolation chamber 20 as shown, for example, in FIGS. 1 and 2. Access devices 44 are mounted in access ports 42 to enable a worker occupying a worker booth 45 alongside isolation booth 12 to handle material (not shown) in isolation chamber 20 without communicating air from worker booth 45 to isolation chamber 20 (and vice versa). Although isolation booth 12 is shown in FIG. 2 as having a rectangular shape and the long side walls 26 are each shown to have two pairs of rubber gloves 44 extending therethrough, it is within the scope of the invention as presently perceived for isolation booth 12 to have some other shape, defined by more or fewer side walls 26, and for some other types of access devices or number of pairs of rubber gloves 44 to be provided.

A person standing alongside one of side walls 26 can insert his or her arms into rubber gloves 44 and grasp the sterile and/or toxic objects (not shown) that are located inside isolation chamber 20 and manipulate or handle the objects as desired. Rubber gloves 44 are air impermeable to provide an effective barrier between the air inside isolation chamber 20 and the person using rubber gloves 44. Side walls 26 include transparent windows 48 and a frame 49 to which windows 48 attach in an air-tight manner. Windows 48 allow the person manipulating the toxic and/or sterile objects to observe the objects. Pedestal 14 supports isolation booth 12 at a sufficient distance above floor 13 to allow a person to use rubber gloves 44 comfortably as shown, for example, in FIG. 1.

Figure 4:
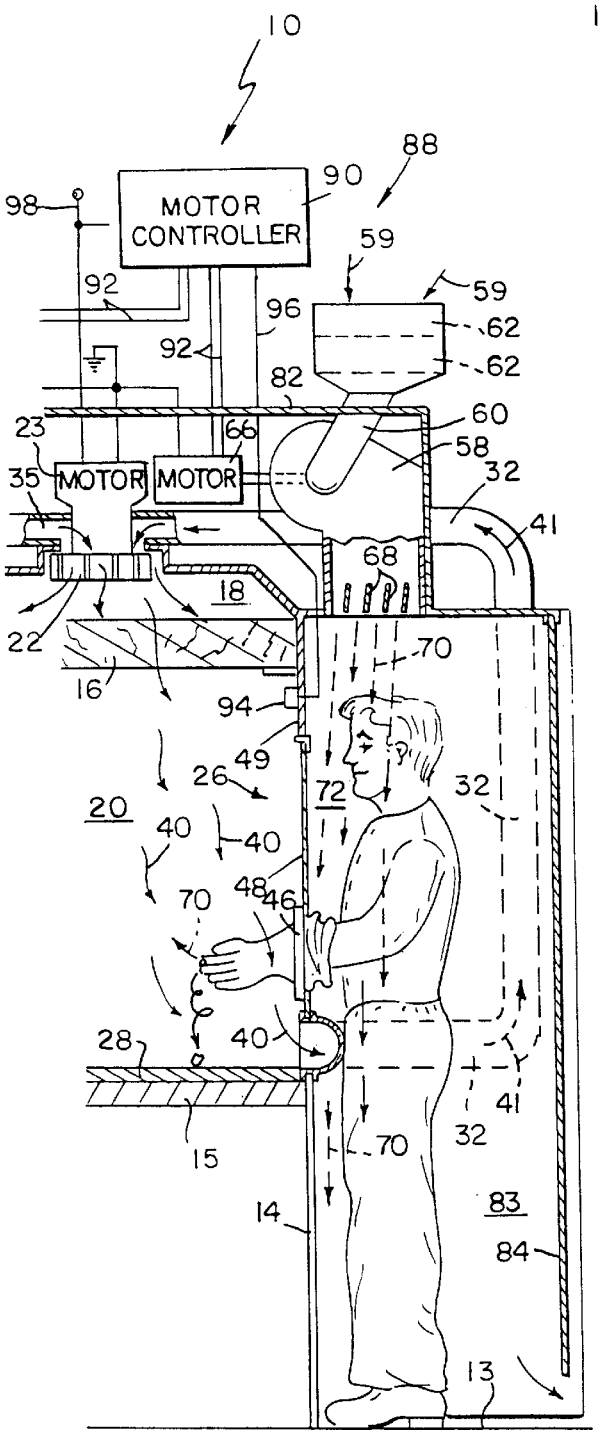
FIG. 4 is a side elevation view similar to FIG. 1 showing the occurrence of a minor leak due to a small break in one of the rubber gloves and showing a small volume of clean air from the air curtain being drawn into the isolation chamber through the small break in the rubber glove.

Occasionally, the normally air-tight connections between the various components of side wall 26 and the various components attached to side wall 26 may inadvertently fail, thereby creating an air leak opening in isolation chamber 20. For example, an air leak opening could occur between one of windows 48 and frame 49 or between one of return air ducts 32 and the associated side wall 26. An air leak opening could also be created due to a small puncture or break in one of rubber gloves 44 as shown in FIG. 4. Because isolation chamber 20 is maintained at a negative pressure relative to the room in which apparatus 10 sets (e.g., air zone 72), when a leak occurs, air is drawn into isolation chamber 20 from a location outside isolation chamber 20. Because outside air is drawn into isolation chamber 20 when a leak occurs, toxic or other fumes in isolation chamber 20 are prevented from escaping from isolation chamber 20 into the ambient surroundings through the air leak opening. An air curtain generator is provided to generate a curtain of clean air that functions to block airborne particles present in the air flowing through the air leak opening into isolation chamber 20 to avoid contamination of the sterile environment inside isolation chamber 20.

Apparatus 10 includes one or more blower fans 58 that are positioned outside isolation booth 12 next to top cover 24 adjacent to side walls 26 as shown in FIG. 1. An inlet duct 60 is coupled to each blower fan 58 and one or more filters 62 are coupled to each inlet duct 62. Filters 62 prevent airborne particles (not shown) from passing along with ambient air 59 into inlet duct 60. Filters 62 can be, for example, HEPA filters that sufficiently filter the air being drawn therethrough by blower fans 58 to create class 100 air or filters 62 can be a higher class of filter, such as a ULPA filter.

Each blower fan 58 also includes an outlet duct 64 arranged to discharge air alongside windows 48 and frames 49 in side wall 26. A motor 66, which is shown diagrammatically in FIG. 1, is coupled to each blower fan 58. Motors 66 operate to turn the associated blower fans 58 causing ambient air 59 to be drawn from the ambient surroundings through filters 62 and discharged as filtered air 70 into inlet duct 60 and then out of outlet duct 64 to create a filtered curtain of air 70 in air zone 72 outside of isolation chamber 20 and adjacent to certain side walls 26 as shown in FIG. 1.

In preferred embodiments, outlet duct 64 is configured and arranged so that filtered air is blown downwardly, as indicated by flow lines 70 shown in FIGS. 1 and 3–5 (dotted arrows), to create a clean "air curtain" adjacent to exterior surfaces of certain side walls 26. The clean air moving in the clean air curtains provides a clean air barrier zone 72 adjacent to exterior surfaces of certain side walls 26 of isolation booth 12 as shown, for example, in FIGS. 1–3. Clean air barrier zones 72 each have sufficient height 74, length 76, and depth 78 effectively to prevent ambient non-clean air 83 from penetrating through zone 72 and coming into contact with side walls 26 of isolation booth 12.

A plurality of individually movable directional vanes 68 are positioned to intercept filtered air 70 discharged through outlet duct 64 as shown in FIG. 1 coupled to outlet duct 64 as shown in FIG. 1. In one embodiment, vanes 68 are coupled to outlet duct 64.

Directional vanes 68 are movable so that the air 70 being blown out of outlet duct 64 into clean air barrier zone 72 can be directed in a desired manner. Movement of directional vanes 68 allows adjustment of depth 78 of clean air barrier zone 72 through which the air 70 of the clean air curtain is moving. Directional vanes 68 can each be adjusted to create contoured custom-designed air curtains. At least one of directional vanes 68 is mounted for movement in or near outlet duct 64 to vary an angle of attack 69 between air 70 moving in the curtain of air zone 72 and adjacent side wall 26 of isolation booth 12.

Figure 3:
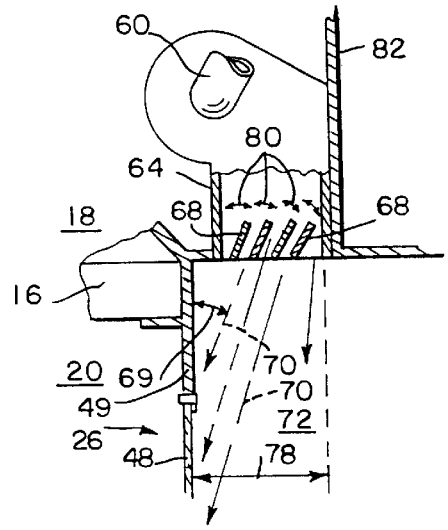
FIG. 3 is a side elevation view of one of the blower fans of FIG. 1, with portions broken away, showing a plurality of directional vanes positioned to lie inside an outlet duct coupled to the blower fan, each of the directional vanes angled in a selected first orientation to direct the clean air of the air curtain toward the side wall of the isolation booth at a selected angle of attack in the direction of the dotted arrows, and each of the directional vanes being individually adjustable manually or by remote control relative to the outlet duct as indicated by the double-headed arrows above the directional vanes to assume other selected orientations to change the angle of attack of the curtain of air relative to the side wall of the isolation booth.

Directional vanes 68 can either be set to a fixed orientation manually or by remote control during the installation of apparatus 10 or can be left free to pivot in the direction of double-headed arrows 80 as shown in FIG. 3. Although depth 78 of clean air barrier zone 72 can be adjusted, the mass flow rate of clean air 70 through clean air barrier zones 72 is established by the speed at which motors 66 and blower fans 58 operate. In a preferred embodiment, each motor 66 is a two-speed motor.

Although clean air barrier zones 72 are shown in FIG. 2 as being created adjacent to two opposing side walls 26 of isolation booth 12, it is within the scope of the invention as presently perceived for more or fewer clean air barrier zones to be created adjacent to respective side walls 26. It is also understood that a plurality of side-by-side motors 66, blowers fans 58, and associated equipment may be needed to provide clean air barrier zones 72 having sufficient length 76 to cover the entire length of a particular side wall 26. As shown, for example, in FIG. 2, a first of walls 26 is formed to include four access ports 42 and a second of walls 26 is formed to include four more access ports 42. An access device 44 is mounted in each of those eight access ports and the air curtain generator includes two laterally spaced-apart motorized blower fans 58 along the first of walls 26 and two more laterally spaced-apart motorized blower fans 58 along the second of walls 26. In the illustrated embodiment, an outlet duct 64 is coupled to each of motorized blower fans 58 and arranged to discharge filtered air 70 into the air zones 72 on opposite sides of isolation chamber 20 so as to establish a first curtain of air in one of the air zones 72 and a second curtain of air in the other of the air zones 72.

Figure 5:
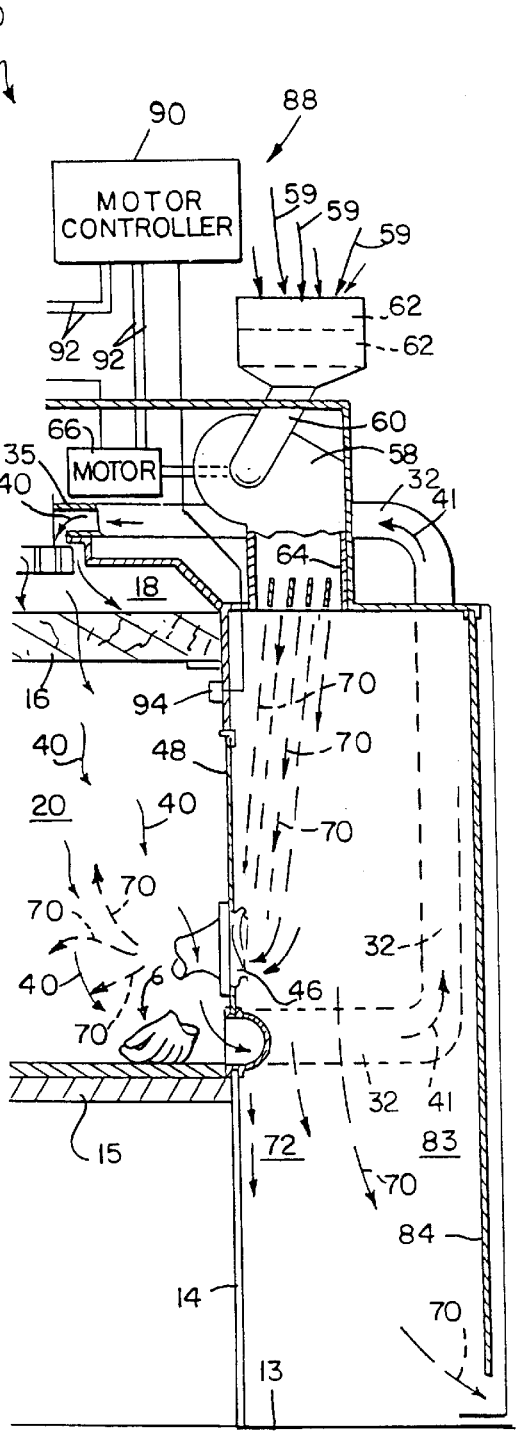
FIG. 5 is a side elevation view similar to FIG. 4 showing the occurrence of a major leak due to a large break in one of the rubber gloves, a large volume of clean air from the air curtain being drawn into the isolation chamber through the large break in the rubber glove, and the control system regulating the motor speed so that the blower fan provides an increased mass flow rate of clean air to the air curtain in response to elevation of the pressure level in the isolation chamber.
Figure 6:
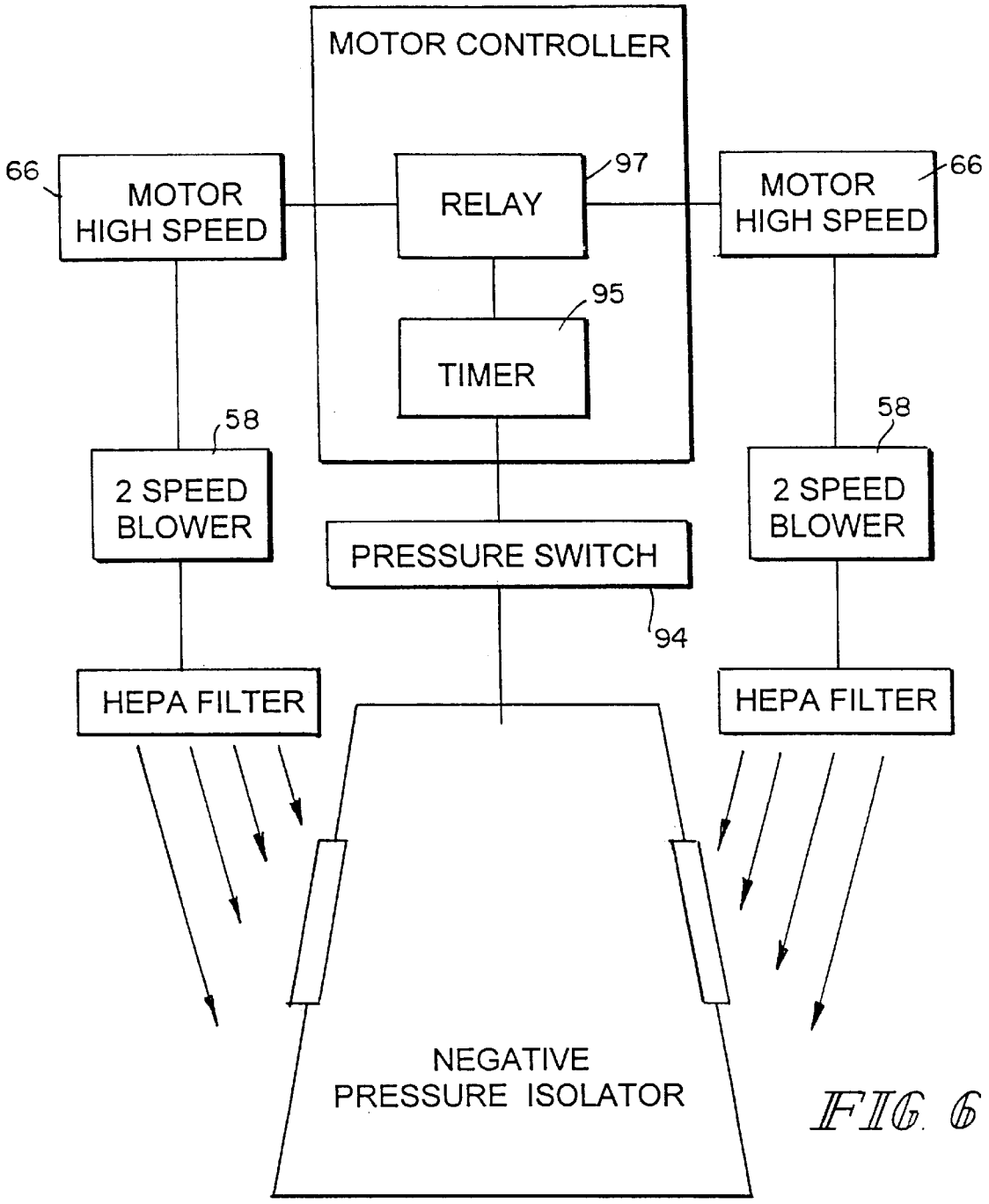

Apparatus 10 can optionally include a hood 82 that overlies isolation booth 12 as shown in FIGS. 1, 4, and 5. Apparatus 10 can also include one or more flexible drapes 84 that hang downwardly from outside edges 86 of hood 82. Drapes 84 provide a "back wall" of each worker booth 45 and an additional barrier to larger airborne particles present in the ambient air outside of drapes 84 and hood 82. Thus, a zone 83 of stagnant non-clean air is positioned to lie in each worker booth 45 between each clean air zone 72 and each respective drape 84 as shown in FIG. 2.

When a minor air leak opening inadvertently occurs, as shown for example in FIG. 4 with regard to a small break in one of rubber gloves 44, a small amount of clean air 70 is drawn from clean air barrier zone 72 into isolation chamber 20 through the air leak opening. Because only clean air 70 is drawn into isolation chamber 20, rather than the ambient air (e.g., air 83) outside of clean air barrier zone 72, the contamination of the sterile environment inside isolation chamber 20 by a large amount of airborne particles in ambient air is avoided.

When a major leak inadvertently occurs, as shown for example in FIG. 5 with regard to a large break in one of rubber gloves 44, a large amount of clean air 70 from clean air barrier zone 72 is drawn into isolation chamber 20 through the air leak opening. In order to ensure that only clean air is drawn into isolation chamber 20 when a major leak occurs, apparatus 10 includes a control system 88 that operates to increase the speed of motors 66 and blower fans 58 so that the mass flow rate of clean air through clean air barrier zone 72 is increased, thereby enhancing the ability of the air curtain in clean air barrier zone 72 to prevent the ambient non-clean air (e.g., 83) from penetrating through clean air barrier zone 72 and entering isolation chamber 20 through the major air leak opening.

Control system 88 is shown diagrammatically in FIGS. 1, 4, and 5. Control system 88 includes a motor controller 90 that is electrically coupled to each motor 66 by conductors 92. A pressure sensor switch 94 is located inside isolation chamber 20 and is electrically coupled to motor controller 90 by a conductor 96. In the illustrated embodiment, pressure sensor switch 94 is mounted to one of side walls 26 just beneath filter 16. Pressure sensor switch 94 senses the pressure of air extant in isolation chamber 20. Motor controller 90 provides an output signal via conductors 92 to regulate the speed at which motors 66 and blower fans 58 operate in response to an input signal provided via conductor 96 from pressure sensor switch 94. In the illustrated embodiment, motor controller 90 includes a timer 95 coupled to pressure sensor switch 94 via conductor 96 and a relay 97 coupled to timer 95 and conductors 92. Pressure sensor switch 94 can be, for example, a photohelic gage. Using pressure sensor switch 94, an alarm condition will exist when the internal pressure in isolator chamber 20 is above a predetermined level relative to the region outside of isolation chamber 20. If this alarm condition is not corrected within a predetermined period of time, the time period being selectable by a customer by adjusting timer 95, relay 97 is activated to take motorized blower fans 58 to their higher speed operating mode. Control system 88 and motor 23 can be coupled to a power source (not shown) by a power cord 98.

In a preferred embodiment, when pressure sensor switch 94 senses that the pressure of isolation chamber 20 has increased to a critical level for a predetermined period of time, say, three seconds or more, an alarm signal is sent to relay 97 in motor controller 90 and relay 97 sends output signals via conductors 92 to switch motors 66 and blower fans 58 from a normal, low speed to a high speed. The increased speed of motors 66 and blower fans 58 increase the mass flow rate of clean air flowing through clean air barrier zone 72 as previously described. Thus, when a major leak occurs, motors 66 and blower fans 58 will be switched into high-speed operation by motor controller 90 if the pressure of isolation chamber 20 increases to the critical level for a set period of time.

The high-speed operation of motors 66 and blower fans 58 blocks non-clean air in zone 83 between clean air barrier zone 72 and the respective drape 84 from being drawn into isolation chamber 20 along with the clean air 70 being drawn into isolation chamber 20 from clean air barrier zone 72. When a small leak occurs or when no leaks occur, motor controller 90 operates motors 66 and blower fans 58 at the normal, low speed so that a person standing in clean air barrier zone 72 in worker booth 45 is not bothered by the velocity of air 70 flowing through clean air barrier zone 72.

Although the invention has been described in detail with reference to a preferred embodiment, variations and modifications exist within the scope and spirit of the invention as described and defined in the following claims.

What is claimed is:

1. An apparatus for providing a clean working environment, the apparatus comprising an isolation booth formed to include an isolation chamber sized to establish a working environment, a worker booth located outside of the isolation chamber and adapted to receive air at a first air pressure, the isolation booth further including a partition wall positioned to lie between the isolation chamber and the worker booth and formed to include an access port communicating with the isolation chamber, an access device mounted in the access port to enable a worker in the worker booth to handle material in the isolation chamber through the access port without communicating air in the worker booth into the isolation chamber, and a pressure generator positioned to communicate with the isolation chamber to generate a second air pressure in the isolation chamber that is less than the first air pressure in the worker booth to cause air to be drawn from the worker booth into the isolation chamber through any air leak opening that develops in and around the access device so as to block outflow of air in the isolation chamber to the worker booth through the air leak opening.

2. The apparatus of claim 1, wherein the isolation booth further includes an air supply plenum and an air permeable filter positioned to lie between the air supply plenum and the isolation chamber to filter air passing from the air supply plenum to the isolation chamber through the air permeable filter and the pressure generator is coupled to the air supply plenum.

3. The apparatus of claim 2, wherein the isolation booth further includes a top wall formed to include an opening into the air supply plenum and the pressure generator lies in the opening.

4. The apparatus of claim 3, wherein the pressure generator includes a blower fan in the air supply plenum and a motor coupled to turn the blower fan to move air in the air supply plenum through the air permeable filter into the isolation chamber to generate the second air pressure in the isolation chamber.

5. The apparatus of claim 3, wherein the isolation booth further includes an air discharge port in communication with the isolation chamber and a return air duct having an inlet end coupled to the air discharge port and an outlet end coupled to the opening formed in the top wall to conduct air discharged from the isolation chamber through the air discharge port into the air supply plenum through the opening formed in the top wall.

6. The apparatus of claim 2, wherein the pressure generator includes a blower fan and a motor coupled to turn the blower fan to move air in the air supply plenum through the air permeable filter into the isolation chamber to generate the second air pressure in the isolation chamber.

7. The apparatus of claim 6, wherein the blower fan lies in the air supply plenum.

8. The apparatus of claim 6, wherein the isolation booth further includes means for conducting air discharged from the isolation chamber to the blower fan for redistribution to the isolation chamber through the air permeable filter.

9. The apparatus of claim 1, further comprising an air curtain generator coupled to the worker booth and arranged to discharge into the worker booth a curtain of air at the first air pressure to the access port formed in the partition wall.

10. The apparatus of claim 9, wherein the air curtain generator includes an outlet duct coupled to the worker booth, a blower fan coupled to the outlet duct, and a motor coupled to turn the blower fan to move air in the outlet duct into the worker booth to generate the curtain of air.

11. The apparatus of claim 10, wherein the air curtain generator further includes at least one directional vane mounted for movement in the outlet duct to vary an angle of attack between air moving in the curtain of air and the partition wall.

12. The apparatus of claim 10, further comprising an air pressure sensor located in the isolation chamber and a motor speed controller coupled to the air pressure sensor and the motor and configured to increase the speed of the motor upon exposure of the air pressure sensor to an air pressure in the isolation chamber above a predetermined pressure level.

13. The apparatus of claim 1, further comprising an air curtain generator coupled to the worker booth and arranged to discharge into the worker booth and along a surface of the partition wall a curtain of air at the first air pressure to the access port formed in the partition wall.

14. The apparatus of claim 13, further comprising means in the air curtain generator for changing an angle of attack of the curtain of air relative tot he surface of the partition wall.

15. The apparatus of claim 14, wherein the changing means includes at least one directional vane mounted for movement in the air curtain generator to change direction of air discharged from the air curtain generator to generate the air curtain.

16. The apparatus of claim 1, further comprising means for discharging a current of air at the first pressure into the worker booth and along at least a portion of the partition wall to reach the access port and the access device to provide a source of high pressure air at the access port so that such source of high pressure air is available to be drawn from the worker booth into air at the second pressure in the isolation chamber through any air leak opening.

17. The apparatus of claim 16, wherein the discharging means includes an outlet duct coupled to the worker booth and a motor coupled to turn the blower fan to move air in the outlet duct into the worker booth to generate the curtain of air.

18. The apparatus of claim 16, wherein the discharging means further includes at least one directional vane the isolation booth further includes means for conducting air discharged from the isolation chamber to the blower fan for redistribution to the isolation chamber through the air permeable filter.

19. The apparatus of claim 17, further comprising an air pressure sensor located in the isolation chamber and a motor speed controller coupled to the air pressure sensor and the motor and configured to increase the speed of the motor upon exposure of the air pressure sensor to an air pressure in the isolation chamber above a predetermined pressure level.

20. The apparatus of claim 1, further comprising means for discharging into the worker booth a current of air at the first pressure at a specified mass flow rate to the access port formed in the partition wall and means for increasing the mass flow rate of the current of air discharged by the discharging means in response to an increase in pressure of air in the isolation chamber to a level above a maximum level for a predetermined period of time.

21. The apparatus of claim 20, wherein the discharging means includes a blower fan and a motor coupled to turn the blower fan to move air into the worker booth to generate the current of air and the increasing means includes an air pressure sensor located in the isolation chamber and a motor speed controller coupled to the air pressure sensor and the motor and configured to increase the speed of the motor upon exposure of the air pressure sensor to an air pressure in the isolation chamber above a predetermined pressure level.

22. An apparatus for providing a clean working environment, the apparatus comprising an isolation booth including a wall and an isolation chamber within the wall, the wall being formed to include an access port communicating with the isolation chamber, an access device mounted in the access port to enable a worker outside the isolation chamber to handle material in the isolation chamber without admitting air into the isolation chamber through the access port, and a pressure generator positioned to communicate with the isolation chamber to generate a chamber air pressure in the isolation chamber that is less than outside air pressure outside the isolation chamber at the access port to cause air to be drawn into the isolation chamber through any air leak opening that develops in and around the access device so as to block outflow of air in the isolation chamber through the air leak opening.

23. The apparatus of claim 22, wherein the isolation booth further includes an air supply plenum and an air permeable filter positioned to lie between the air supply plenum and the isolation chamber to filter air passing from the air supply plenum to the isolation chamber through the air permeable filter and the pressure generator is coupled to the air supply plenum.

24. The apparatus of claim 22, further comprising an air curtain generator arranged to discharge a curtain of air at the outside air pressure to the access port formed in the wall.

25. The apparatus of claim 24, wherein the air curtain generator includes a blower fan and a motor coupled to turn the blower fan to move air relative to the wall to generate the curtain of air.

26. The apparatus of claim 25, wherein the air curtain generator further includes an outlet duct coupled to the blower fan to receive air discharged from the blower fan and at least one directional vane mounted for movement in the outlet duct to vary an angle of attack between air moving in the curtain of air and the wall.

27. The apparatus of claim 25, further comprising an air pressure sensor located in the isolation chamber and a motor speed controller coupled to the air pressure sensor and the motor and configured to increase the speed of the motor upon exposure of the air pressure sensor to an air pressure in the isolation chamber above a predetermined pressure level.

28. The apparatus of claim 22, further comprising means for discharging a current of air at the outside air pressure along at least a portion of the wall outside the isolation chamber to reach the access port and the access device to provide a source of high pressure air at the access port so that source of high pressure air is available to be drawn into air at the chamber air pressure in the isolation chamber through any air leak opening.

29. The apparatus of claim 28, wherein the discharging means includes a blower fan and a motor coupled to turn the blower fan to move air relative to the wall to generate the curtain of air.

30. The apparatus of claim 29, further comprising an air pressure sensor located in the isolation chamber and a motor speed controller coupled to the air pressure sensor and the motor and configured to increase the speed of the motor upon exposure of the air pressure sensor to an air pressure in the isolation chamber above a predetermined pressure level.

31. The apparatus of claim 28, further comprising means for increasing the mass flow rate of the current of air discharged by the discharging means in response to an increase in pressure of air in the isolation chamber to a level above a maximum level for a predetermined period of time.

32. An apparatus for providing a clean working environment, the apparatus comprising an isolation booth formed to include an isolation chamber sized to establish a working environment, a top cover above the isolation chamber, a wall alongside the isolation chamber, a first access device mounted in a first access port formed in the wall to enable a worker outside the isolation chamber to handle material in the isolation chamber without admitting air into the isolation chamber through the first access port, and a pressure generator coupled to an opening formed in the top cover to communicate with the isolation chamber to generate a chamber air pressure in the isolation chamber that is less than outside air pressure at the first access port to cause air to be drawn into the isolation chamber through any air leak opening that develops in and around the first access device so as to block outflow of air in the isolation chamber through the air leak opening.

33. The apparatus of claim 32, wherein the isolation booth further includes an air supply plenum and an air permeable filter positioned to lie between the air supply plenum and the isolation chamber to filter air passing from the air supply plenum to the isolation chamber through the air permeable filter and the pressure generator is coupled to the air supply plenum.

34. The apparatus of claim 32, wherein the wall is also formed to include second, third, and fourth access ports, and further comprising a second access device mounted in the second access port, a third access device mounted in the third access port, a fourth access device mounted in the fourth access port, and an air curtain generator arranged to discharge air at the outside air pressure to each of the first, second, third, and fourth access ports.

35. The apparatus of claim 34, wherein the wall includes a first side wall portion and a second side wall portion positioned to lie in spaced-apart relation to the first side wall portion to locate the isolation chamber therebetween and under the top cover and the first, second, third, and fourth access ports are formed in the first side wall portion.

36. The apparatus of claim 35, wherein the air curtain generator includes an outlet duct positioned to communicate with the first side wall portion, a blower fan coupled to the outlet duct, and a motor coupled to turn the blower fan to move air in the outlet duct to generate a curtain of air discharged through the outlet duct to reach the first, second, third, and fourth access ports.

37. The apparatus of claim 34, wherein the wall includes a first side wall portion and a second side wall portion positioned to lie in spaced-apart relation to the first side wall portion to locate the isolation chamber therebetween and under the top cover, the first and second access ports are formed in the first side wall portion, and the third and fourth access ports are formed in the second side wall portion.

38. The apparatus of claim 37, wherein the air curtain generator includes a first outlet duct positioned to communicate with the first side wall portion, a first blower fan coupled to the first outlet duct, a first motor coupled to turn the first blower fan to move air in the first outlet duct to generate a first curtain of air discharged through the first outlet duct to reach the first and second access ports, a second outlet duct positioned to communicate with the second side wall portion, a second blower fan coupled to the second outlet duct, and a second motor coupled to turn the second blower fan to move air in the second outlet duct to generate a second curtain of air discharged through the second outlet duct to reach the third and fourth access ports.

39. The apparatus of claim 34, wherein the wall is also formed to include fifth, sixth, seventh, and eighth access ports, and further comprising a fifth access device mounted in the fifth access port, a sixth access device mounted in the sixth access port, a seventh access device mounted in the seventh access port, and an eighth access device mounted in the eighth access port, and the air curtain generator is arranged to discharge air at the outside air pressure to each of the fifth, sixth, seventh, and eighth access ports.

40. The apparatus of claim 39, wherein the wall includes a first side wall portion formed to include the first, second, third, and fourth access ports and a second side wall portion positioned to lie in spaced-apart relation to the first side wall portion to locate the isolation chamber therebetween and under the top cover, the second side wall portion is formed to include the fifth, sixth, seventh, and eighth access ports, and further comprising a first worker booth positioned to lie alongside the first side wall portion to enable a worker in the first worker booth to handle material in the isolation chamber using at least one of the first, second, third, and fourth access devices and a second worker booth positioned to lie alongside the second side wall portion to enable a worker in the second worker booth to handle material in the isolation chamber using at least one of the fifth, sixth, seventh, and eighth access devices, and the air curtain generator includes a first outlet duct positioned to discharge air into the first worker booth and along the first side wall portion, a second outlet duct positioned to discharge air into the second worker booth and along the second side wall portion, and means for blowing air at the outside air pressure through the first outlet duct to generate a first curtain of air moving in the first worker booth to reach the first, second, third and fourth access ports and through the second outlet duct to generate a second curtain of air moving in the second worker booth to reach the fifth, sixth, seventh, and eighth access port.

41. The apparatus of claim 39, wherein the wall includes a first side wall portion formed to include the first, second, third, and fourth access ports and a second side wall portion positioned to lie in spaced-apart relation to the first side wall portion to locate the isolation chamber therebetween and under the top cover, the second side wall portion is formed to include the fifth, sixth, seventh, and eighth access ports, and further comprising a first worker booth positioned to lie alongside the first side wall portion to enable a worker in the first worker booth to handle material in the isolation chamber using at least one of the first, second, third, and fourth access devices and a second worker booth positioned to lie alongside the second side wall portion to enable a worker in the second worker booth to handle material in the isolation chamber using at least one of the fifth, sixth, seventh, and eighth access devices, and the air curtain generator includes a first pair of outlet ducts positioned in spaced-apart relation to one another to discharge air into the first worker booth and alongside the first wall, a second pair of outlet ducts positioned in spaced-apart relation to one another to discharge air into the second worker booth, and means for blowing air at the outside air pressure through the first pair of outlet ducts to generate a first curtain of air moving in the first worker booth to reach the first, second, third, and fourth access ports and through the second pair of outlet ducts to generate a second curtain of air moving in the second worker booth to reach the fifth, sixth, seventh, and eighth access ports.

* * * * *